US011267277B2

(12) United States Patent
Nunez et al.

(10) Patent No.: US 11,267,277 B2
(45) Date of Patent: Mar. 8, 2022

(54) SECURITY ELEMENT COMPRISING A PRINTED IMAGE WITH A THREE-DIMENSIONAL EFFECT

(71) Applicant: GIESECKE+DEVRIENT MOBILE SECURITY GMBH, Munich (DE)

(72) Inventors: Juan Nunez, Barcelona (ES); Oliver Muller, Barcelona (ES)

(73) Assignee: GIESECKE+DEVRIENT MOBILE SECURITY GMBH, Munich (DE)

( * ) Notice: Subject to any disclaimer, the term of this patent is extended or adjusted under 35 U.S.C. 154(b) by 149 days.

(21) Appl. No.: 16/625,896

(22) PCT Filed: Jun. 22, 2018

(86) PCT No.: PCT/EP2018/000314
§ 371 (c)(1),
(2) Date: Dec. 23, 2019

(87) PCT Pub. No.: WO2019/001763
PCT Pub. Date: Jan. 3, 2019

(65) Prior Publication Data

US 2020/0147992 A1 May 14, 2020

(30) Foreign Application Priority Data

Jun. 27, 2017 (DE) ..... 10 2017 006 040.1

(51) Int. Cl.
*B42D 25/455* (2014.01)
*B42D 25/351* (2014.01)
(Continued)

(52) U.S. Cl.
CPC ..... *B42D 25/455* (2014.10); *B42D 25/351* (2014.10); *B42D 25/355* (2014.10);
(Continued)

(58) Field of Classification Search
CPC .. B42D 25/455; B42D 25/351; B42D 25/355; B42D 25/48
See application file for complete search history.

(56) References Cited

U.S. PATENT DOCUMENTS 3,905,849 A * 9/1975 Bomboire ..... B44C 3/025 156/79
5,346,571 A * 9/1994 Condon ..... B44C 1/105 156/212
(Continued)

FOREIGN PATENT DOCUMENTS

DE 20219788 U1 4/2003
EP 2886357 A2 6/2015
(Continued)

OTHER PUBLICATIONS

"Identification Cards—Physical Characteristics," ISO/IEC 7810, Third Edition, Nov. 1, 2003.
(Continued)

*Primary Examiner* — Christle I Marshall
(74) *Attorney, Agent, or Firm* — Workman Nydegger

(57) ABSTRACT

A method for manufacturing a physical security element with a spatially appearing pattern includes a carrier and at least one see-through transparent cover layer. Onto the carrier is applied a design layer deformable under pressure. Either the carrier has a lower dimensional stability under heat than the cover layer, or a cover layer has a lower dimensional stability under heat than the carrier. A see-through transparent structural layer forming the pattern is arranged between carrier and cover layer. The structural layer has a higher dimensional stability under heat than either the carrier or a cover layer. During lamination, the structural layer is pressed into the carrier or into the cover layer, whereby the design layer is deformed under the pattern formed by the structural layer and the structural layer
(Continued)

in its edge regions is reshaped in such a way that its surfaces, in cross-section, converge tangentially.

14 Claims, 3 Drawing Sheets

(51) Int. Cl.
*B42D 25/355* (2014.01)
*B42D 25/48* (2014.01)
*B42D 25/40* (2014.01)
*B42D 25/425* (2014.01)
*B42D 25/46* (2014.01)

(52) U.S. Cl.
CPC ..... *B42D 25/40* (2014.10); *B42D 25/425* (2014.10); *B42D 25/46* (2014.10); *B42D 25/48* (2014.10)

(56) References Cited

U.S. PATENT DOCUMENTS 5,804,285 A * 9/1998 Kobayashi ..... B32B 3/30 428/172
7,455,235 B2 11/2008 Le Gouic et al.
7,637,537 B2 12/2009 Keller et al.
7,907,339 B2 * 3/2011 Tompkin ..... B42D 25/373 359/569
8,403,230 B2 3/2013 Endres et al.
2003/0127847 A1 7/2003 Keller et al.
2011/0020606 A1 * 1/2011 Herslow ..... B32B 27/30 428/162
2011/0174884 A1 7/2011 Endres et al.

FOREIGN PATENT DOCUMENTS

EP 2593314 B1 5/2016
JP S60193637 A 10/1985
WO 0162516 A1 8/2001
WO 2004065135 A1 8/2004
WO 2010037526 A2 4/2010
WO 2012007563 A2 1/2012

OTHER PUBLICATIONS

"Identification Cards—Physical Characteristics, Amendment 1: Criteria for Cards Containing Integrated Circuits," ISO/IEC 7810, Dec. 15, 2009.
"Identification Cards—Physical Characteristics, Amendment 2: Opacity," ISO/IEC 7810, Jan. 15, 2012.
German Search Report from DE Application No. 102017006040.1, dated Feb. 28, 2018.
International Search Report and Written Opinion from PCT Application No. PCT/EP2018/000314, dated Oct. 4, 2018.

* cited by examiner

SECURITY ELEMENT COMPRISING A PRINTED IMAGE WITH A THREE-DIMENSIONAL EFFECT

BACKGROUND

The invention relates to a method for manufacturing a physical security element having a spatially appearing printed image and to a corresponding security element. In particular, the invention relates to a card made of plastic, for example a credit card or a payment card having a spatial printed image which forms a security feature.

From EP 2593314 B1 a method for manufacturing a plastic card having a printed image is known, in which onto a substrate there is first printed a coating containing metallic, organic or non-organic pigments. Onto the coating there is printed a lacquer layer which forms a pattern and which is thinner than the coating. The lacquer layer is cured. The coating possesses a higher plasticity than the lacquer. On top of the lacquer layer there is applied a cover layer. Subsequently, the construction is laminated under pressure and temperature. During lamination, the harder lacquer is completely pressed into the softer coating, the lacquer maintaining its form. The lacquer notched into the coating in this way makes the visibility of the pattern formed by the lacquer dependent on the viewing angle. The manufacturing of the coating in this known method requires the employment of special materials as well as the performance of special steps, which makes the performance of the method elaborate. Further, the possible penetration depth of the lacquer into the coating is limited by the height thereof. This is normally very low compared to the height of the substrate.

From U.S. Pat. No. 7,455,235 B2 there is known a method for manufacturing a chip card having a visual relief effect. According to this method, a full-area layer of metallic ink is applied onto a core. On top of this a lacquer layer is applied with a greater thickness, which forms a pattern. The lacquer layer is hardened by means of UV light, subsequently an even thicker cover layer is applied. Thereafter, this construction is laminated. During lamination, the lacquer layer becomes dull, while the regions of the card not covered by the lacquer layer remain brilliant. This results in a three-dimensional effect. The partial additional height caused by the lacquer layer is compensated by the cover layer. The resulting dull regions appear to be engraved into the card surface. The known solution supplies an independent card feature. However, it cannot easily be combined with other card features and requires the configuration of a sufficiently soft and sufficiently thick cover layer.

From EP 2886357 A2 there is known a security document having a security feature, which is constructed from several foils laminated together, is based on a relief structure and produces a three-dimensional impression. The relief structure is produced with the aid of a relief lacquer and/or by embossing the surface of the foil carrying the relief lacquer.

From WO 2004/065135 A1 there is known a method for manufacturing a three-dimensional image on a card body, in which first a reflective layer is configured on the back side of a transparent core layer and on top of this an image-forming material is applied, which can be driven into the core layer. A transparent cover layer is laid over the image-forming material. The layer arrangement given thereafter is laminated into a card body. In doing so, the image-forming material is driven into the reflective layer and core layer and produces an embedded image. Upon subsequent viewing from the front side of the core layer, an intensified reflection arises at the contoured edges of the resulting embedded image, which reflection supports a three-dimensional visual impression.

SUMMARY

It is the object of the invention to provide a method for manufacturing a spatially appearing pattern on a security element, which can be implemented without any special demands on the materials to be utilized or on the method steps to be performed and which supplies a feature which can be easily combined with other features.

This object is achieved by a method and a security element with the features according to the independent claims.

The method according to the invention has the advantage that it can be carried out with common manufacturing methods and does not place increased demands on the materials to be utilized. The method supplies in a simple manner shapes and symbols that appear spatially. The feature manufacturable by the method is particularly suitable for common payment cards, credit cards and ID cards.

A special advantage of the method according to the invention is that when it is carried out no other structural components of the security element, which are provided specifically for the manufacturing of features, are damaged or impaired. In particular, no feature-forming layers are damaged during the manufacturing of cards.

The method according to the invention is based on the approach of configuring, on a multi-layer security element, a structural layer which includes a pattern. The structural layer is pressed into the core layer of the security element by lamination, thereby also deforming a design layer connected to the core layer. In doing so, the thickness of the design layer is not or only insignificantly changed. By the deformation of the design layer, the pattern contained in the structural layer becomes recognizable as a spatially perceptible image structure.

In a particularly advantageous configuration, the structural layer is applied as a lacquer layer in a printing method. The lacquer used is preferably transparent.

Further advantageous developments and expedient configurations of the method according to the invention result from the features of the dependent claims.

BRIEF DESCRIPTION OF THE DRAWINGS

Embodiment examples of the invention will hereinafter be explained in more detail with reference to the drawing.

There are shown.

DETAILED DESCRIPTION OF VARIOUS EMBODIMENTS

Figure 1:
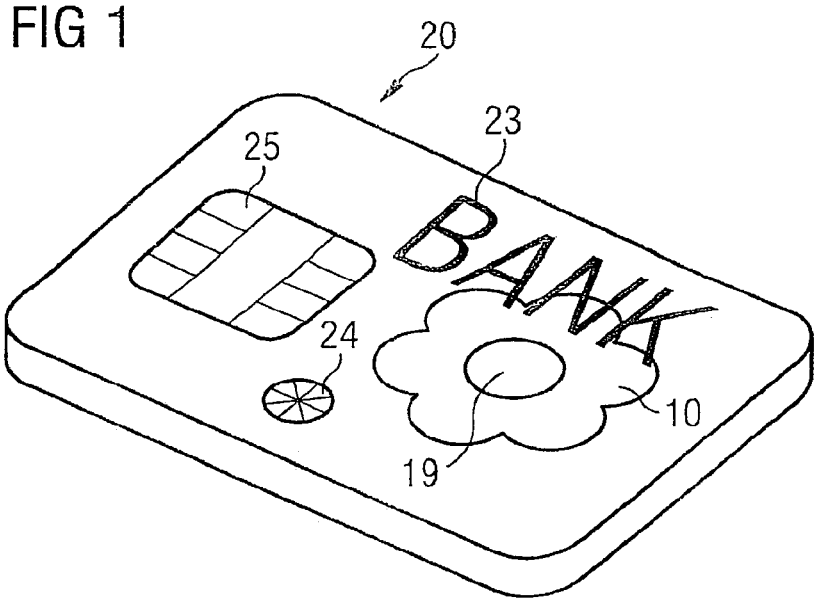
FIG. 1 shows a card furnished with features in a partial perspective view.

The method according to the invention is described below by the example of a plastic card in a standard format, as they are commonly used as payment cards, credit cards or ID cards. FIG. 1 shows by way of example a chip card whose geometry corresponds for example to ISO 7810. However, the method is not restricted to plastic cards, but is generally suitable for physical security elements which are constructed from several layers connected under pressure and heat and which have a printable surface such as e.g. labels, signs or packaging.

FIG. 1 shows a card having a chip 25 as an example of a physical security element 20 in a partial perspective plan view. The card 20 typically possesses standard dimensions, e.g. according to ISO 7810. Its surfaces are smooth and lie plane-parallel to each other. On the side arbitrarily referred to as upper surface 21, the card 20 carries several features optically recognizable for a user, some of which serve individualization and some security. In particular, the card 20 carries a pattern 10 manufactured with the method of the invention. The pattern 10 covers a part of the surface 21 and possesses a recess 19 in which the surface 21 is visible. Further, the card 20 also carries a lettering 23 which is partly applied over the pattern 10. It also carries a separate security feature, such as a hologram 24.

Figure 2:
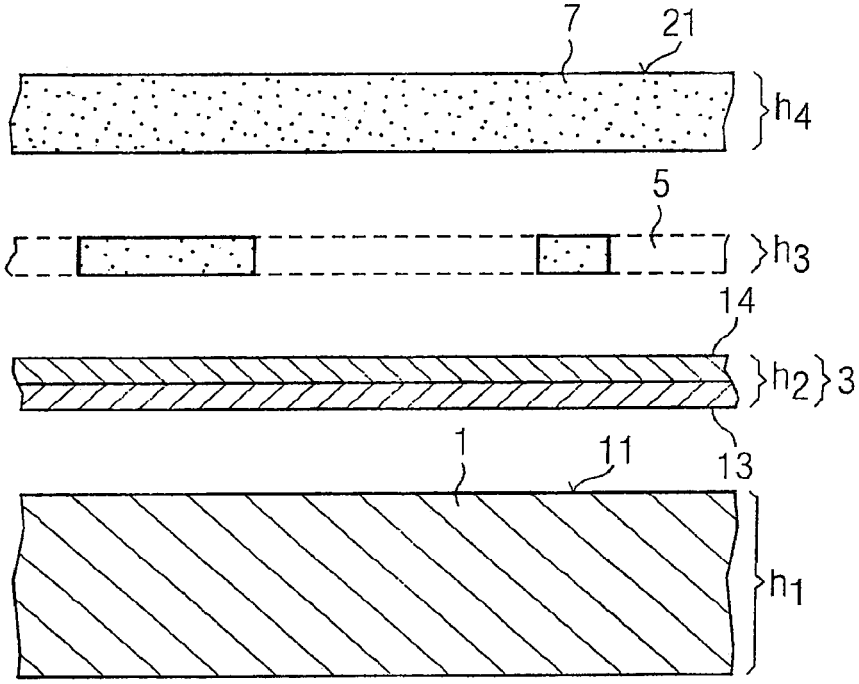
FIG. 2 components to be joined before connecting, by the example of a card.

FIG. 2 shows a first embodiment variant of a method for producing a pattern 10 on a card 20. In an exploded representation which is not true to scale, a part of the components of the board 20 is shown before connecting. The basis of the card 20 is a carrier 1 made of a thermoplastic material which normally is provided in the form of a plastic layer or of a composite of several plastic layers. The plastic can be PVC but can also be different common card materials. If the card to be manufactured corresponds to the ISO standard for credit cards, the carrier 1 typically possesses a thickness $h_1$ of 250 to 700 μm. The carrier 1 forms the core layer of the card 20. The practical thickness of the carrier 1 depends on the chosen card format, the intended purpose of use, specific requirements for certain card layers and/or the desired number and thickness of individual layers which form the carrier 1.

A design layer 3 is placed above the carrier 1. The design layer 3 is opaque or semi-transparent. It is usually applied over the full area of the surface 11 of the carrier 1 and possesses a thickness $h_2$ of 5 to 25 μm. Typically, the design layer 3 is applied onto the carrier 1 by screen printing. Expediently, a usual design ink is used which is based on a transparent solution furnished with color particles. In addition, it may contain e.g. metallic particles which generate a particular optical effect, for example a glitter effect.

In an alternative embodiment, the design layer 3 can also be provided as a separate layer in the form of a foil.

As indicated in FIG. 2, the design layer 3 can be executed in a multi-layered manner. It then consists, for example, of a base layer 13 which for instance is executed as a white layer. Thereon there is located an optically effective layer 14 which is executed as a layer having metallic particles, for example. In one variant, the base layer 13 can be formed by a thin metal foil on which a design print 14 is applied as the second layer. Hereinafter, design layer 3 is always represented as a single layer for simplifying the description. Above the design layer 3 there lies a structural layer 5. The structural layer 5 is see-through transparent, i.e. transparent or semi-transparent. It typically covers only a part of the surface 11 of the carrier 1. The structural layer 5, in a plan view, forms a pattern 10 which represents a pictorial or alphanumeric information item. The pattern 10 may be a simple closed geometric shape, such as a dot or rectangle, or possess a complex form which has recesses 19, such as letters, design patterns or pictorial motifs. As an example of a complex pattern 10, in FIG. 1 there is indicated a stylized flower the center of which is formed by a recess 19. The pattern 10 does not cover the entire area of the card. It consists of inner zones 16 and edge regions 15, which differ in their optical effect.

In the embodiment example of FIG. 2, the structural layer 5 is executed in the form of a lacquer layer. Such a lacquer layer 5 is based on a solvent or is solvent-free and is printed in a screen printing method. The printing can be done either on the cover layer 7 or on the design layer 3. After the application, the lacquer layer is cured. Its thickness $h_3$ expediently is between 25 μm and 100 μm; in the practical tests the thickness was between 30 and 60 μm.

As an alternative to an embodiment as a lacquer layer, the structural layer 5 can also be executed as an independent foil in which the pattern 10 is incorporated in the form of a structure of recesses.

Above the structural layer 5 there lies a cover layer 7. Its top side is smooth and forms the surface 21 of the card 20. The cover layer 7 is also see-through transparent, i.e. transparent or semi-transparent. It is expediently provided as a foil and possesses a thickness $h_4$ of 50 to 100 μm. Expediently, its thickness is between 60 and 80 μm.

Compared to the other components, the carrier 1 possesses a higher plasticity, i.e. its shape can be permanently changed at a lower temperature than with the other components. The glass transition temperature of the carrier 1 is lower than that of the cover layer 7.

The cover layer 7 behaves hard in comparison to the carrier 1 and also in comparison to the other components and experiences no or hardly any shape changes by a usual lamination, i.e. it can be compressed by at most 15%.

The structural layer 5 possesses a greater or a similar dimensional stability under heat as the carrier 1. Under pressure and heat during lamination it experiences a change of shape in its edge regions 15, while for the rest it substantially maintains its shape and is compressed by at most 10%.

Likewise, the design layer 3 possesses a higher dimensional resistance under heat than the carrier 1. The design layer 3 can hardly be compressed under usual laminating conditions, i.e. its thickness changes by at most 15%. However, the design layer 3 can be deformed by the action of pressure without its thickness being changed. Connecting the components represented in FIG. 1 is effected in two phases: in the first phase the design layer 3 is applied onto the carrier 1 and the structural layer 5 is applied onto the design layer 3 or onto the cover layer 7. In the second phase, the components present thereafter are connected to each other under pressure and heat in a usual laminating method.

During lamination, the carrier 1 behaves softly towards the design layer 3 and the lacquer layer 5. The carrier 1 also behaves softly towards the cover layer 7 and the structural layer 5. This means that while cover layer 7, structural layer 5, design layer 3 and lacquer layer 5 completely or at least fundamentally maintain their shape during lamination, the carrier 1 changes its shape. During lamination, the lacquer layer 5 is pressed into the carrier 1. Together with the lacquer layer 5, the design layer 3 is pressed into the carrier 1. The carrier 1 is thus compressed and reshaped wherever the lacquer layer 5 is located.

The lacquer layer 5 remains basically unchanged during lamination, but the edge regions 15 change their shape. The inner zones 16 of the lacquer layer 5 remain substantially unchanged. In particular, in the inner zones the thickness of the lacquer layer 5 remains substantially unchanged; the laminating can result in at most a low homogeneous compression of the thickness of max. 10%. In the edge regions 15, however, the lacquer layer 5 is reshaped lenticularly. When viewed in cross-section, the lower surface 18 of the lacquer layer 5 which faces the carrier 1 and the upper surface 1 which faces the cover layer 7 extend tangentially towards each other after reshaping and form an acute angle. And the lower surface 18 rises in the edge regions 15 towards the upper surface 17.

During lamination the design layer 3 is deformed where the lacquer layer 5 is located, but this does not or only insignificantly change its thickness, i.e. less than 10%, and the design layer 3 remains contiguous.

Figure 3:
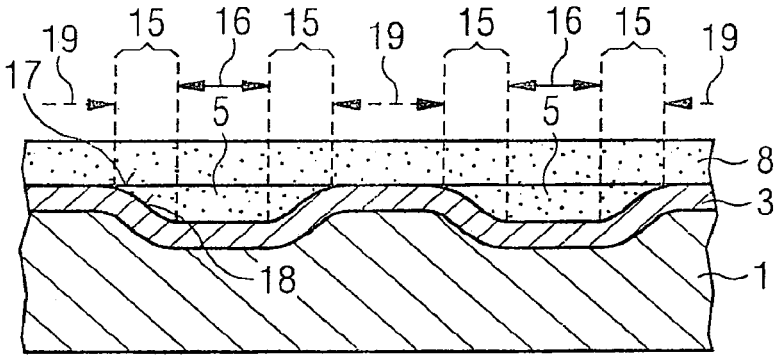
FIG. 3 a detail of a card manufactured with the components according to FIG. 1 after connecting, FIG. 4 a plan view of a detail of a card manufactured according to the FIG. 1 or 2, FIG. 5 a variant of the method according to FIG. 1 before the connecting, and FIG. 6 a card manufactured according to the variant of FIG. 4 after connecting.

FIG. 3 illustrates the resulting card construction after the components represented in FIG. 2 were laminated together. In the regions of the card 20 where the lacquer layer 5—and thus the pattern 10—is configured, the carrier 1 is compressed and reshaped accordingly. The lacquer layer 5 is pressed into the carrier 1, taking the intermediate design layer 3 with it. The design layer 3 is deformed according to the contour of the structural layer 5, but has not or only insignificantly changed its thickness, i.e. by at most 10%, and has remained contiguous. The lacquer layer 5 is substantially undeformed in the inner zones 16, i.e. its thickness has changed by at most 10%, and in the edge regions 15 is has been reshaped lenticularly. The lacquer layer 5 thus runs out in the edge regions 15, forming a gentle transition by decreasing the layer thickness, until it disappears. The design layer 3 accordingly lies in the inner zones 16 between the structural layer 5 and the carrier 1. In the edge regions 15, it respectively rises in a gentle, continuous transition towards the cover layer 8 in order to tangentially meet the cover layer 7 at the transitions to the recesses 19 or to the adjacent regions of the surface 21 without pattern 10. In the recesses 19 or in the regions of the surface 21 without pattern 10, the design layer 3 directly abuts the cover layer 7.

The gentle transitions between regions with lacquer layer 5 and regions without lacquer layer 5, which arise in the edge regions 15 of lacquer layer 5, lead to an, in plan view, optically perceptible effect, because light in the edge zones 15 is reflected differently than in the inner zones 16 and in the zones outside the pattern 10 in which only the design layer 3 is present. The impact of the effect produced by the edge regions 15 is that the pattern 10 represented by the lacquer layer 5 appears to be spatial.

Figure 4:
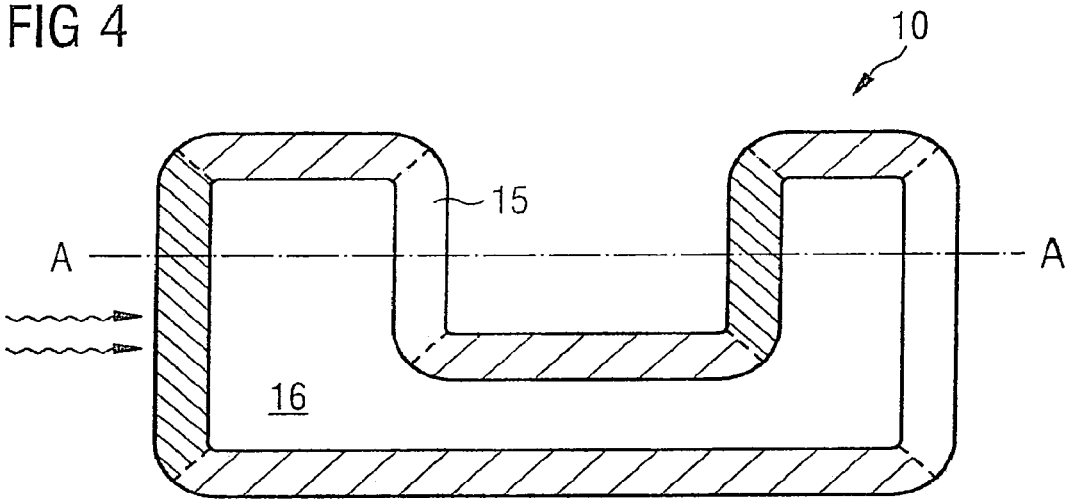

FIG. 4 illustrates the spatial effect. There is shown a card 20 in plan view, which has a pattern 10 manufactured according to the methods described. The pattern 10 in the example is an asymmetric "U". The cross-section through the pattern 10 along line A-A corresponds in principle to the cross-section represented in FIG. 3. If the represented pattern 10 receives e.g. incidence of light from the left side, as indicated by the arrows, the edge regions 15 appear to reflect differently strong, depending on whether they are inclined away from the incidence of light, are parallel to it, or are inclined towards the incidence of light. In this manner, the edge regions 15 produce a depth effect. The pattern 10 in combination thus becomes perceptible as a spatial structure in the design layer 3.

Figure 5:
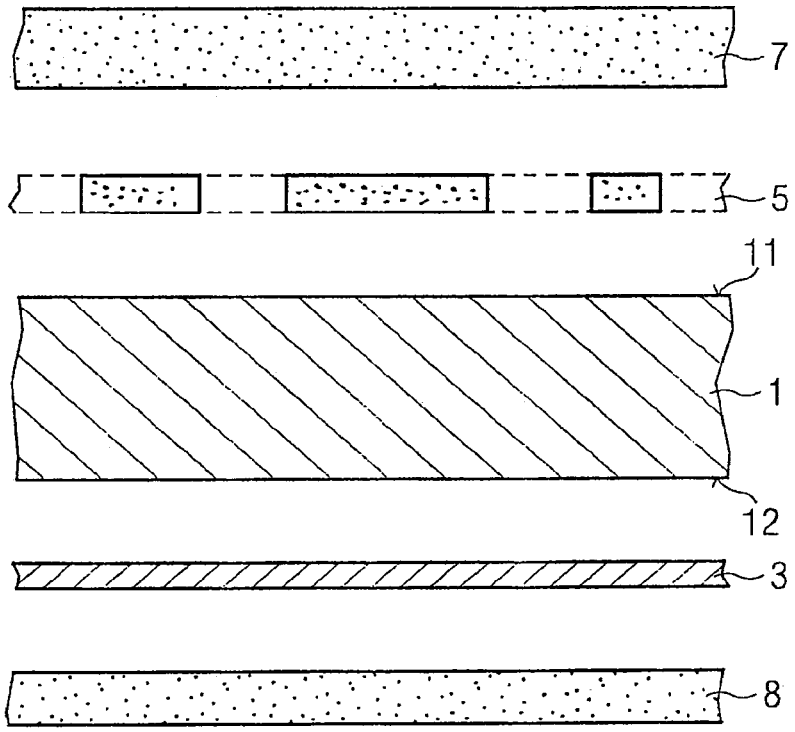
Figure 6:
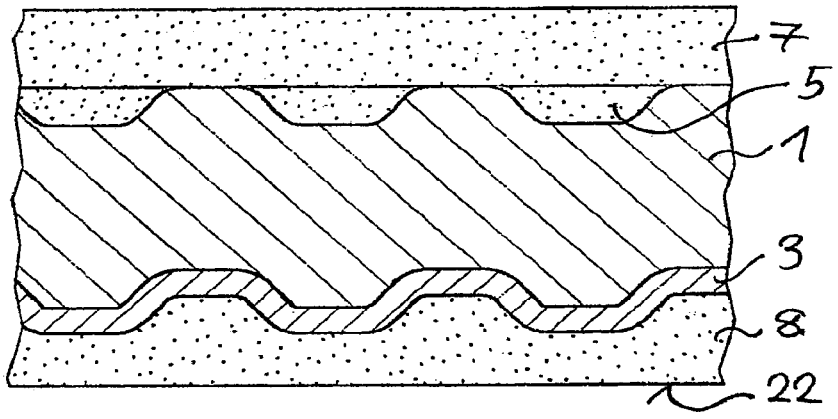

FIGS. 5 and 6 show an embodiment variant of the method described, in which the structural layer 5 is pressed indirectly via the carrier layer 1 into a cover layer 8. Here, the design layer 3 is not configured on the side 11 of the carrier 1 which faces the structural layer 5, but on the side 12 facing away. Furthermore, above the structural layer 5, there is arranged a further cover layer 8, likewise on the side facing away. Its top side is smooth and forms the lower surface 22 of the card 20. The further cover layer 8, like the cover layer 7, is see-through transparent and possesses a thickness of 50 to 150 μm, expediently of 60 to 90 μm. However, the further cover layer 8 possesses a lower dimensional stability under heat and a higher plasticity than carrier 1 and also than design layer 3. This means that the further cover layer 8 is more easily plastically deformable than carrier 1 and design layer 3 and possesses a lower glass transition temperature.

During the lamination of the arrangement shown in FIG. 5, the structural layer 5 is pressed into the carrier 1. Here, the structural layer 5 again changes its cross-sectional profile in the edge regions 15 as shown in FIG. 2 and is reshaped. By the pressed-up structural layer 5, in turn the carrier 1 is deformed and reproduces the surface contour thereof. However, the carrier 1 here—unlike the embodiment example of FIG. 2—is not or at most insignificantly reshaped in its profile and maintains its thickness $h_1$ substantially over the entire area; "insignificant" is understood here to mean a homogeneous change in a dimension of at most 10%. Instead of undergoing reshaping, the carrier 1 merely deforms and on the side facing away reproduces the contour of the structural layer 5.

On the side 6 facing away, the carrier 1 presses on the design layer 3 and the further cover layer 8. The design layer 3 is deformed by the carrier 1 but again substantially maintains its thickness $h_2$, i.e. changes by at most 10%, and remains contiguous. This results in the design layer 3 in turn reproducing the contour of the structural layer 5 and being pressed into the further cover layer 8.

Unlike in the embodiment example of FIG. 2, in the variant according to FIG. 5 now the further cover layer 8 is compressed and thereby reshaped. As a result of the deformation of the edge regions 15, the pattern 10 represented by the structural layer 5 thus becomes perceptible on the opposite side 6 of carrier 1 as a spatial pattern.

While maintaining the basic idea of configuring a pattern 10 having a spatial effect on a multi-layer security element 20 by deforming an inner layer of the security element 20, which carries a design layer 3, with the aid of a structural layer 5, whereby the structural layer 5 itself is reshaped lenticularly at its edge regions 15, the method described allows a series of reasonable and obvious modifications. For example, it is possible to provide further layers in the layer constructions which are either also deformed or not deformed.

The invention claimed is:

1. A method for manufacturing a physical security element having a spatially appearing pattern, comprising the steps of:

providing a carrier, providing at least one see-through transparent cover layer, applying a design layer onto the carrier, wherein either the carrier has a lower dimensional stability under heat than the cover layer, or a cover layer has a lower dimensional stability under heat than the carrier, wherein the design layer is deformable under pressure, wherein the thickness of the design layer is not changed or is changed by a maximum of 10%, by the deformation, arranging a see-through transparent structural layer between carrier and cover layer forming the pattern, wherein the structural layer has a higher or a similar dimensional stability under heat than the carrier or a cover layer, laminating the carrier and the layers under pressure and heat, wherein during lamination the structural layer is pressed into the carrier or via the carrier into a cover layer, whereby the design layer is deformed in accordance with the pattern formed by the structural layer, and whereby the structural layer in its edge regions is reshaped in such a way that, in cross-section, the surfaces of the structural layer converge tangentially.

2. The method according to claim 1, wherein the carrier has a lower dimensional stability under heat than design layer, cover layer and structural layer, and the structural layer is arranged between design layer and cover layer so that during lamination the design layer is pressed into the carrier by the structural layer, wherein the structural layer in its edge regions is reshaped lenticularly in such a way that the surface of the structural layer which faces the top layer and the surface of the structural layer which faces the design layer converge tangentially at the edges.

3. The method according to claim 1, wherein the design layer is applied onto the side of and facing away from the carrier, and a further cover layer is arranged thereabove the design layer, wherein the further cover layer has a lower dimensional stability under heat than design layer, cover layer, carrier and structural layer, and the structural layer is arranged between carrier and cover layer, so that during lamination the design layer and the carrier are pressed into the further cover layer by the structural layer, wherein the structural layer is reshaped lenticularly in such a way that the surface of the structural layer which faces the cover layer and the surface of the structural layer which faces the design layer converge tangentially at the edge regions thereof.

4. The method according to claim 1, wherein the structural layer is applied as a lacquer layer onto the design layer and/or the cover layer.

5. The method according to claim 4, wherein the lacquer layer is hardened.

6. The method according to claim 1, wherein the design layer is a metallic ink and/or is applied onto the carrier before the lamination.

7. The method according to claim 1, wherein the surface of the structural layer which faces the design layer rises towards the surface which faces the cover layer.

8. The method according to claim 1, wherein the design layer has a thickness of 5 to 25 μm and/or is applied in the form of at least two layers which differ in a material property.

9. The method according to claim 1, wherein the structural layer possesses a thickness of 25 to 125 μm.

10. The method according to claim 1, wherein the cover layer possesses a thickness of 50 to 200 μm.

11. The method according to claim 1, wherein the structural layer is substantially undeformed in the inner zones, and the edge regions are reshaped lenticularly, forming a transition by decreasing the layer thickness until it disappears.

12. A physical security element which carries a spatially appearing pattern, having a carrier on which a design layer, a see-through transparent structural layer and a see-through transparent cover layer are configured, wherein the structural layer covers only parts of the security element and the pattern is formed wholly or partially by the structural layer, wherein the structural layer is pressed into the carrier and is reshaped lenticularly at its edge regions so that the surfaces of the structural layer converge tangentially in the edge regions, and through the structural layer also the design layer is pressed into the carrier, the design layer being deformed in accordance with the pattern in the structural layer, wherein the thickness of the design layer in the deformed regions is the same or, apart from deviations of max 10%, almost the same as in the rest of the regions.

13. The security element according to claim 12, wherein it is configured in the form of a card in a standardized format.

14. A method for manufacturing a physical security element having a spatially appearing pattern, comprising the steps of:

providing a carrier, providing at least one see-through transparent cover layer, applying a design layer onto the carrier, wherein either the carrier has a lower dimensional stability under heat than the cover layer, or a cover layer has a lower dimensional stability under heat than the carrier, wherein the design layer is deformable under pressure, arranging a see-through transparent structural layer between carrier and cover layer forming the pattern, wherein the structural layer has a higher or a similar dimensional stability under heat than the carrier or a cover layer, laminating the carrier and the layers under pressure and heat, wherein during lamination the structural layer is pressed into the carrier or via the carrier into a cover layer, whereby the design layer is deformed in accordance with the pattern formed by the structural layer, and whereby the structural layer in its edge regions is reshaped in such a way that, in cross-section, the surfaces of the structural layer converge tangentially;

wherein the structural layer is substantially undeformed in the inner zones, and the edge regions are reshaped lenticularly, forming a transition by decreasing the layer thickness until it disappears.

* * * * *